US009737974B2

(12) United States Patent
Eliason

(10) Patent No.: US 9,737,974 B2
(45) Date of Patent: Aug. 22, 2017

(54) WET ABRASIVE BLASTING SYSTEM WITH SELF-VENTING ASSEMBLY

(75) Inventor: Keith Eliason, Virginia Beach, VA (US)

(73) Assignee: Graco Minnesota Inc., Minneapolis, MN (US)

( * ) Notice: Subject to any disclaimer, the term of this patent is extended or adjusted under 35 U.S.C. 154(b) by 556 days.

(21) Appl. No.: 13/234,478

(22) Filed: Sep. 16, 2011

(65) Prior Publication Data

US 2013/0072094 A1 Mar. 21, 2013

(51) Int. Cl.
*B24C 3/00* (2006.01)
*B24C 7/00* (2006.01)

(52) U.S. Cl.
CPC ..... *B24C 7/0007* (2013.01)

(58) Field of Classification Search
CPC .... B24C 7/0007; B24C 7/0015; B24C 7/0023
USPC ..... 451/100, 101, 99
See application file for complete search history.

(56) References Cited

U.S. PATENT DOCUMENTS 1,504,048 A * 8/1924 Jorgensen ..... 451/100
1,535,939 A * 4/1925 Moore ..... 451/100
1,585,549 A * 5/1926 Jorgensen ..... 451/100
1,877,255 A * 9/1932 Sammis ..... 451/100
2,389,616 A * 11/1945 Franklin ..... 451/100
2,409,722 A * 10/1946 Stark et al. ..... 451/100
2,447,272 A * 8/1948 Parkes ..... 52/578
2,569,952 A * 10/1951 Ridley ..... 451/100
2,938,305 A * 5/1960 Bipes ..... 451/99
3,034,263 A * 5/1962 McDaniel et al. ..... 451/100
3,331,163 A * 7/1967 Gregory ..... 451/99
3,343,304 A * 9/1967 Eppler ..... 451/99
4,075,789 A * 2/1978 Dremann ..... 451/99
4,439,073 A * 3/1984 White ..... 406/125
4,709,515 A * 12/1987 Copeland et al. ..... 451/99
4,801,333 A * 1/1989 Mosell ..... 134/7
5,097,633 A * 3/1992 Branton et al. ..... 451/5
5,195,280 A * 3/1993 Nicholson et al. ..... 451/99
5,283,991 A * 2/1994 Keizers ..... 451/101
5,865,902 A * 2/1999 Yam et al. ..... 134/7
6,083,001 A * 7/2000 Deardon et al. ..... 433/88
6,431,950 B1 * 8/2002 Mayes ..... B24B 37/005 222/145.1
8,057,279 B2 * 11/2011 Connelly ..... 451/2
2010/0252120 A1 * 10/2010 Delves ..... B65D 90/626 137/2
2012/0202407 A1 * 8/2012 Nguyen ..... 451/101

* cited by examiner

*Primary Examiner* — Joseph J Hail
*Assistant Examiner* — Joel Crandall
(74) *Attorney, Agent, or Firm* — Benard G. Pike; Pike IP Law, PLLC

(57) ABSTRACT

The invention is directed toward wet-abrasive blasting systems used for cleaning, preparing surfaces, removing coatings, and other abrasive blasting applications. The wet abrasive basting system has a blast pot that includes a venting system. The venting system may be a self-venting system that allows gases to be vented during charging and prevents gases from accumulating in the blast pot during operation. In wet abrasive blasting systems a slurry is conveyed via a piping system, hoses, etc. to a mixer connected to a source of pressurized gas where slurry and compressed air/gas are combined and directed through the blast hose and blast nozzle.

7 Claims, 1 Drawing Sheet

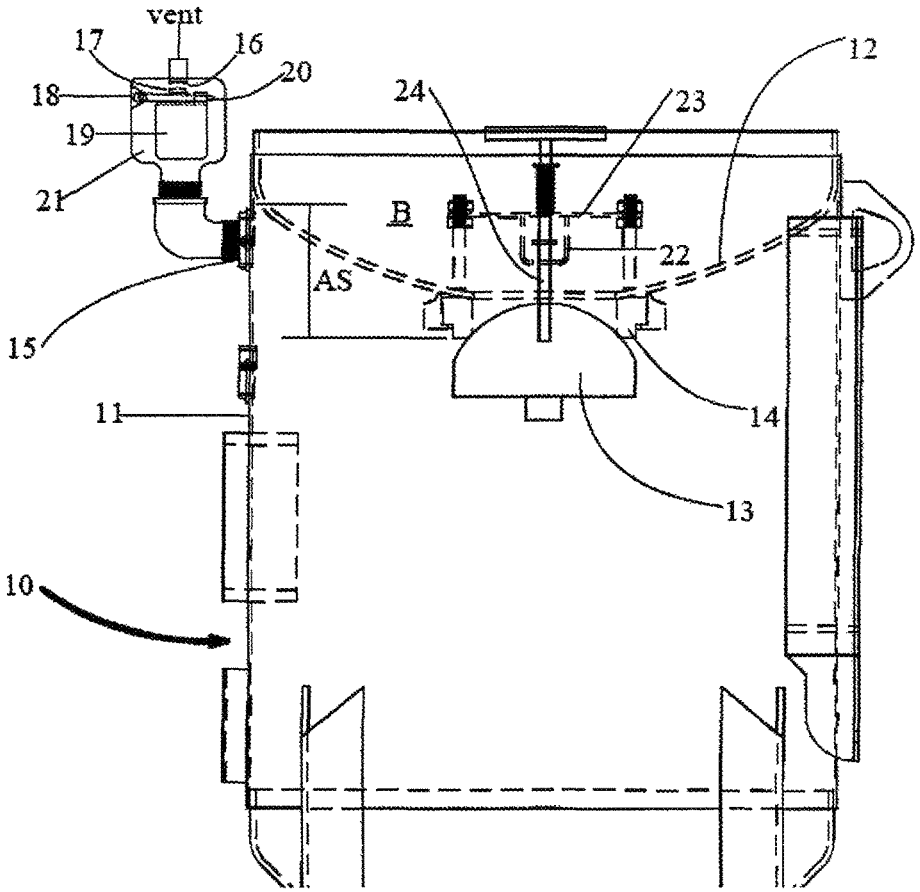
vent
17
16
20
18
19
21
24
23
12
B
22
AS
15
11
14
13
10

WET ABRASIVE BLASTING SYSTEM WITH SELF-VENTING ASSEMBLY

FIELD OF THE INVENTION

The invention is directed toward wet abrasive blasting systems used for cleaning, preparing surfaces, removing coatings, and other abrasive blasting applications. Embodiments of the wet abrasive basting system comprise a venting system on the blast pot. The venting system may be a self-venting system that prevents gases from accumulating in the blast pot. In wet abrasive blasting systems, a slurry is conveyed via a piping system, hoses, etc. to a mixer connected to a source of pressurized gas where slurry and compressed air/gas are combined and directed through the blast hose and blast nozzle.

BACKGROUND

To remove corrosion, rust, slag, paint, or coatings from a substrate such as a surface to be restored, painted, or cleaned, an abrasive blasting system is both desirable and necessary. In certain applications, abrasive blasting systems should be able to clean or remove corrosion, rust, slag, paint, or coatings without damaging the underlying metal or other substrate. In other applications, a certain degree of surface roughening (called profile) may be desired to assure new paint or coating adhesion.

The use of dry, hard abrasives, such as those used in conventional sand blasting, may result in excessive surface roughness to the point of causing damage to the substrate. Typical blast particles are hard (2.8~9 on Mohs Scale of Mineral Hardness) and abrasive in order to increase the efficiency of the blasting operation. Soft blast particles (generally less than 2 on the Mohs scale), such as agricultural products which can include crushed walnut shells, rice hulls, corn cob, and pistachio shells, plastic or glass particles are sometimes used to reduce substrate surface damage.

Wet-abrasive systems have been used to control the generation of dust and minimize surface damage, even while using hard abrasives. Wet-abrasive systems rely on a method to force a slurry of the abrasive media into the compressed air-stream in a controlled manner. A blast pot or pressure vessel is charged with a liquid, typically water, and the solid abrasive to form the slurry. The blast pot is then purged of air, sealed, and connected to a source of pressurized water. The flow of pressurized water forces the slurry out of the blast pot, through a slurry piping system, and into a mixer. Also connected to the mixer is a source of pressurized gas, typically air. In the typical case, the water and abrasive slurry is mixed with the compressed air to form a three phase blasting stream of abrasive, water and air and directed through the blast hose and directed with the blast nozzle to the surface. Fluctuations in flow or pressure in either the slurry or pressurized gas at the mixer will provide inconsistent behavior of the wet abrasive blasting system and an inefficient blasting process.

There exists a need for a wet abrasive blasting system with increased consistency in pressure and flow at the mixer and ultimately at the blasting nozzle.

SUMMARY

Embodiments of the wet blasting system comprise a blast pot and an automatic air vent valve connected to a top portion of the blast pot. The automatic air vent valve may be connected to an upper portion of an inner volume of the blast pot to vent any air that accumulates in the blast pot. In a preferred embodiment, the automatic air vent valve is connected to the upper most portion of an inner volume of the blast pot.

The inventors have discovered that wet-abrasive blasting systems should be designed based on the principle that fluids, commonly used for wet-abrasive blasting, will not compress. If the blast pot is full of incompressible fluids, pumping additional fluid into the blast pot necessitates that an equal amount of slurry be forced out of a bottom outlet of the vessel. If a significant amount of air is present, the air or other gas may be compressed (producing an accumulator effect where the volume of the pressure vessel occupied by the air or other gas is reduced and the volume occupied by the fluid and particulates increases), which could preclude the expected amount of slurry from being forced out of the vessel.

Removal of substantially all of the trapped air or other gas from within the filled pressure vessel provides an efficient and predictable control of the volume of slurry that will be forced into the compressed air-stream and thus propelled through the blast hose and blast nozzle to perform wet-abrasive blasting. Manual purging of air/gas, although widely used, provides inconsistent results and does not adequately deal with new, additional air that may be introduced into the vessel after it is sealed and pressurized. In addition, manually opening a valve to purge air would most likely result in liquid run-off at the location of the blast pot, as both fluid and air will escape due to the fact that the air volume is not easily determined and the operator cannot determine the exact point at which all air/gas is expelled and liquid starts to exit. Consequently, additional manual venting will cause fluid to escape until the operator can react to the situation. Further, the operator may not realize the blast pot needs to be purged of air to improve system performance.

The self-venting system can release substantially all of the air or other gases introduced during the fill process (with minimal fluid release) and the self-venting system may also automatically release any air or other gas introduced while the wet-abrasive blast unit is in operation. During operation, a properly functioning wet blast system typically comprises a fluid pump for pressurizing the blast pot and pumping additional fluid into the blast pot, which in turn forces the same volume of slurry out of the bottom outlet of the blast pot and into a slurry/gas mixer.

An automatic vent valve in a self-venting system eliminates the need to manually determine if air is present in the blast pot and to manually vent the air. Automatic vent valves may be designed to purge only air or other gases and the vent's seat is automatically sealed before fluid escapes. The self-venting system prevents the possibility of the operator forgetting to manually purge all of the air from the pressure vessel resulting in pressure fluctuations in the piping systems and inefficient blasting operation. Further, the self-venting system eliminates the need to manually "catch" and properly dispose of fluids that escape along with the purged air during manual venting.

As used in this document, "force-mixed into the compressed air-stream" is defined as a method to force slurry in a pipe into a connecting point that is incorporated in a compressed air piping system. Both piping systems (the compressed air and the pressurized slurry) may have a means of shutting off flow simultaneously, so that the forced mixing occurs only during the time when the compressed air is moving through the circuit and into the blast hose and nozzle.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of components, parts, techniques and steps are disclosed. Each of these has individual benefit and each can also be used in conjunction with one or more, or in some cases, all of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

BRIEF DESCRIPTION OF THE FIGURE

The invention will now be described with the reference to the drawing wherein:

The FIGURE depicts an embodiment of a blast pot comprising a self-venting assembly.

DESCRIPTION OF EMBODIMENTS OF THE INVENTION

The invention relates to wet abrasive blasting systems. Embodiments of the wet abrasive blasting system may comprise a blast pot having a self-venting assembly. The self-venting assembly is capable of purging air from the blast pot without operator action during pressurizing and operation of the wet abrasive blasting system. In some embodiments, the wet abrasive blasting system comprises a blast pot and an automatic air vent valve connected to a top portion of the blast pot. The automatic air vent valve is capable of releasing air from the blast pot without releasing a significant amount of fluid. The automatic air vent valve may be positioned in a top portion of the blast pot such that the blast pot remains substantially full of liquid and abrasive.

The wet abrasive blasting system may further comprise a slurry piping system, a pressurized air piping system and a mixer. Typically, the slurry piping system will connect a bottom outlet of the blast pot to a mixer. In certain embodiments of the wet abrasive blasting system, the blast pot contains a mixture of a solid particulate and a fluid (hereinafter "slurry"), and the slurry piping is capable of conveying the desired flow rate of slurry from the blast pot to the mixer to be combined with the pressurized gas. The pressurized gas piping system connects a source of pressurized gas to the mixer and is capable of conveying the desired flow rate of pressurized gas at a desired pressure to the mixer. Typically, the gas will be air and the fluid will be water, but other gases and fluids may be used. In addition, additives may be added to the fluid or the gas, as desired. The abrasive media may include media in the range of United States Standard Sieve Screen Size 100μ~10μ. The media and water are mixed into the pressure vessel; the ratio is inconsequential. A blast pot, typically, comprises a cone-shaped bottom with an outlet at the lowest point of the vessel. Since the media is heavier than water, the slurry is funneled into a hose or pipe that connects the blast pot to the input piping of the control panel. The slurry piping system and/or the pressurized gas piping system may be comprised of pipe and other components as desired to control the flow and pressure.

The inventor's discovered that wet abrasive blast systems operate and should be designed on the principle that the fluids in the slurry cannot be compressed. Therefore, the volume of abrasive slurry pushed out of the blast pot and mixed into the compressed air stream is controlled by the amount of fluid forced into the substantially filled pressure vessel. In such a case, as a volume of water is pumped into the blast pot, an equal volume of wet-abrasive media must be forced out of the pressure vessel. However, air trapped in the pressure vessel during filling or air that may accumulate in the pressure vessel or blast pot after purging due to worn pump seals, or a suction leak in the fluid pump's inlet hose, or from a fluid source that includes trapped air bubbles, will compress and cause fluctuations in the flow and/or the pressure of slurry stream. These fluctuations in flow and pressure may be at least partially due to the accumulator effect caused by the trapped compressed air/gas. As used herein, "accumulator" or "accumulator effect" is defined as a storage reservoir in which fluid is held under pressure with a compressible gas which can be further compressed or pressurized without forcing fluids out of the vessel when additional fluid is added to the reservoir. Since the compressible gas may be further compressed the reservoir may hold an additional volume of fluid as the volume of compressible gas is reduced.

In conventional dry blasting, this pressure vessel would contain both abrasive and compressed air or other gas in a top portion of the blast tank, the trapped compressed air/gas forces the dry media out of the bottom of the tank to the blast hose. However, in wet-abrasive blasting systems, the pressure vessel contains a slurry of abrasives and fluid (usually water) when "charged." Gas trapped in the pressure vessel above the slurry is undesirable as the trapped air results in a accumulator affect in the blast pot and is detrimental to the consistent and efficient means of forcing the wet-abrasive media into the mixer with the compressed air.

The air or other gas may become trapped in the space between the underside of the basin-shaped enclosure and the inside top of the cylinder, which makes up the cylindrical body of the pressure vessel (for example, the air space AS shown in the Figure). Some blast pots are equipped with a manual vent valve to remove air from the air space. However, this manual method has its shortcomings due to the fact that the operator may not realize the blast pot has accumulated air and that manually venting also allows fluid to escape along with the trapped air/gas. Wet abrasive blasting system operators typically will rely on the release of fluid from the vent valve to ensure the air and other gases is released. The operator has no other visible means of determining the exact moment when all of the air/gas has been expelled and the operator waits to see the escaped flow of liquid as an indication of when to manually close the valve. This is a major concern, especially in states or other locations where a run-off of liquid could be deemed as a violation of their ecology protection laws.

The inventors were the first to realize the advantages of a wet abrasive blasting system comprising a blast pot having a self-venting system wherein air and other gas is automatically vented during the filling and pressurizing of the pressure vessel without allowing fluid to escape. The self-venting system additionally has the advantage of venting any air or other gas that may unknowingly be introduced into the purged, pressurized vessel during use or idle time via worn pump seals, a suction leak in the pump's fluid source hose or piping, or even due to natural air bubbles that are trapped in the fluid being fed to the fluid pump, for example. Because wet abrasive blasting system operators generally do not manually re-purge the pressurized vessel of new air/gas (because there is no direct indicator when there is air in the system and venting could cause fluid run-off due as the fluid escapes simultaneously or after the air is purged), the inventors realized an automatic vent valve would provide a wet blasting system that prevents the accumulator effect and has improved efficiency and performance.

In wet abrasive blasting systems wherein the blast pot is experiencing an accumulator effect, the pressure fluctuations at the mixer may result in uneven mixing ratios of slurry and air moving through the blasting hose and/or slurry backing up into the air supply piping system. Embodiments of the wet blasting systems comprising a self-venting assembly prevents this accumulator effect by allows air to escape from the blast pot before problems are realized.

Embodiments of the wet abrasive blasting system may comprise a vertically mounted, cylindrical pressure vessel with the inwardly sloping top welded enclosure in the general shape of a basin as shown in the Figure. The basin comprises a sealable inlet hole allowing access into the inner volume of the blast pot. The sealable hole may be sealed by a pressure tight lid that is secured by any means such as, but not limited to, spring loaded, bolts, threaded, swing bolts, clamps, or other securing means. (Some models of the EcoQuip™ wet abrasive blasting systems comprise a spring-loaded bung to seal the inlet hole.) The purpose of the inward sloping top or basin is to provide a convenient means to fill the blast pot with abrasive media and fluid (the basin serves as a funnel to guide the particulate blast media and fluid into the hole in the top of the vessel).

The blast pot may be of any design capable of storing the slurry and maintaining the pressure of the system. Typical blast pots for wet abrasive blasting systems comprise cylindrical side walls and a conical shaped bottom leading to the bottom slurry outlet of the blast pot and into the slurry piping system, though other configurations may be used. The top and/or the bottom of the blast pot may be any configuration such as, but not limited to, flat, round, conical, elliptical, inward sloping, basin shaped, or upward sloping, for example. In one embodiment, the blast pot comprises a threaded outlet such as outlet 15 in the Figure to be located as high as possible in the inner volume of the tank, for example, in the area below the welding of the basin shaped top to the cylindrically shaped outer housing. The outlet may be any outlet capable of connecting the self-venting assembly or automatic vent valve to the blast pot and in fluid communication with its inner volume. The outlet may be a welded connection, threaded connection, flanged connection, quick connector, and/or tubing connector. The self-venting assembly may further comprise a piping system between the blast pot and the automatic vent valve. In an embodiment of the wet abrasive blasting system, the outlet is in communication with a top portion of the inner volume of the blast pot and, in a more specific embodiment, the outlet is in fluid communication with the highest point of the inner volume within the blast pot.

An automatic vent valve may be connected to the outlet. The automatic vent valve may be any type of valve capable of venting air from a pressurized vessel. The valve may be a float type valve or an automatic control valve that operates based upon a sensor measuring air within the pressurized vessel.

For example, the automatic vent valve may be a float type valve as shown in the Figure. During the final stage of "charging" or filling the blast pot, the blast pot is sealed. For example, the spring-loaded bung as shown in the Figure is released from its open position and allowed to seal the pot under the biasing force of the spring. (Pressurization of the fluids cannot take place unless the pot is sealed). As additional fluid/water is pumped to fill or charge the blast pot, the air or other gas will escape through the self-venting system's vent until the fluid level fills the tank and the vent is sealed. In an embodiment of the wet abrasive blasting system with a float-type vent valve, the fluid level raises thereby lifting the float and causing its vent seal to tightly press against the vent's seat. Should new air/gas be introduced into the pressurized vessel, after it has been filled, sealed, and purged, the air/gas physically rises to the top portion of the vessel (in the air space between the underside of the basin shape and the cylindrical outer shell, for example) and temporarily causes the float to release its seal from the vent's seat enough to vent the gas. The air would continue to vent until the float is again lifted by the rise of fluid and the seal would again engage the vent's seat and prevent any significant amount of fluid from escaping.

As used herein, "pipe" shall mean any fluid containment device used to convey liquid or gas, such as a tube, hose, duct, pipe, or other similar structure. The pipe may have any cross-sectional shape, including rectangular, square, circular, or other shape. The flow area of the pipe is defined by its internal cross-sectional area.

As used herein, "piping system" shall mean pipe and other components used to connect one part of a system to another. The other components may include, but are not limited to: valves, check valves, elbows, tees, reducers, regulators, connectors, gauges or sensors such as flow, temperature or pressure gauges, and control valves.

As used herein, "fluid" or "fluids" are liquids, preferably substantially incompressible fluids, such as water.

An embodiment of a blast pot 10 comprising a self-venting assembly is shown in the Figure. The blast pot 10 comprises vertical cylindrical side wall 11 and top 12. Top 12 forms a basin with a filling hole able to be sealed by a spring loaded bung 13. The spring loaded bung 13 forms a pressure tight seal 14 capable of sealing the blast pot 10. Embodiments of the wet abrasive system with a self-venting system may or may not comprise a spring-loaded bung 13 but may comprise another means of charging and sealing the blast pot. The abrasive media and water may be added through the hole in the top 12. As the blast pot 10 is filled with particulate and liquid, air may escape through the same hole in top 12 until the water level reaches the seal 14. At that point, the basin B will begin to fill and an air space AS is trapped in the top portion of blast pot 10. However, the embodiment of the blast pot 10 in the Figure comprises a self-venting assembly connected to outlet 15. The self-venting assembly comprises a vent seal 16 that may be sealed closed by seat 17 attached to float 19 on lever 20. The vent seal 16 and seat 17 are in the open position (as shown) as long as float 19 on a lever 20 is in the lower position. As the automatic vent valve chamber 21 fills with liquid, the liquid lifts float 19 to an upper position which raises lever 20 on its hinge 18. This moves seat 17 against vent seal 16 closing the vent. If additional air enters automatic vent valve chamber 21, the float 19 will move to a lower position opening vent seal 16 to allow the pressurized air to escape the chamber 21 and allow chamber 21 to be substantially with liquid, again raising seat 17 to seal vent seal 16 to prevent release of the liquid. As long as the chamber 21 is substantially filled with liquid, seat 17 will prevent escape of liquid from the vent. Other styles of automatic vent valves may also be used on embodiments of the self-venting assembly.

In the embodiment shown in the Figure, the spring-loaded bung 13 comprises a bracket 22 mounted below the spider plate 23. The spider plate 23 is above the hole in the basin B through which the bung's guide-rod passes. The bracket 22 serves at least two purposes: (1) the bottom of the bracket 22 becomes the lower surface for a locking device to hold the bung 13 in the open position during the filling process and (2) a center hole in the bracket 22 acts to align the bung's guide-rod 24 and eliminates the need for a bung alignment counterweight. The spring-loaded bung system simplifies the "charging" of the pressure vessel and makes the process as free from "operator error" as possible.

The self-venting system does not require the spring-loaded bung system in order for it to work. The spring-loaded bung keeps the pressure vessel closed during idle time. This spring loaded sealing prevents debris from contaminating the inside of the vessel. This also prevents precipitation from entering the vessel during idle time, which could freeze and be detrimental to ball valves and other components associated with the pressure vessel. The spring-loaded bung and self-venting system enables "charging" the pressure vessel without any fluid remaining in the top of the basin—above the seal. Therefore, the operator can travel with a sealed pressure vessel (whether "charged" or "uncharged") and avoid spillage, thus not violating ecology laws about run-off in some states.

The self-venting system and the spring-loaded bung are two separate devices installed on the same pressure vessel to comprise a system that works together to simplify the venting of air/gas from a pressure vessel, and more importantly, it does so without any excess significant fluid run-off or unnecessary spillage.

The embodiments of the described wet abrasive blasting systems, self-venting assemblies and methods are not limited to the particular embodiments, components, method steps, and materials disclosed herein as such components, process steps, and materials may vary. Moreover, the terminology employed herein is used for the purpose of describing exemplary embodiments only and the terminology is not intended to be limiting since the scope of the various embodiments of the present invention will be limited only by the appended claims and equivalents thereof.

Therefore, while embodiments of the invention are described with reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

The invention claimed is:

1. A wet abrasive blasting system, comprising:

a blast pot, wherein the blast pot comprises:

a cylindrical side wall, a conical bottom having a bottom outlet, an inwardly sloping top in the general shape of a basin an upper most portion of an inner volume of the blast pot defined between the underside of the inwardly sloping top and an inside top of the cylindrical side wall of the blast pot, an outlet connected to the cylindrical side wall at the upper most portion of an inner volume of the blast pot, and a self-venting assembly, wherein the self-venting assembly is connected to the outlet in the cylindrical side wall;

a mixer;

a blast hose in fluid communication with the mixer;

a slurry piping system connecting the bottom outlet of the blast pot to the mixer;

a pressurized air piping system capable of connecting a source of pressurized air to the mixer; and the self-venting assembly, comprises:

an automatic vent valve that operates based upon a sensor measuring air within the blast pot, wherein the automatic vent valve opens to release air from the blast pot that may become trapped in the upper most portion of the blast pot, without releasing a significant amount of fluid, through the automatic vent valve until the fluid level fills the blast not and the automatic vent valve is automatically sealed to prevent escape of liquid.

2. The wet abrasive blasting system of claim 1, wherein a pipe connects the outlet in the cylindrical side wall and the automatic vent valve.

3. The wet abrasive blasting system of claim 1, wherein the outlet in the cylindrical side wall is one of a welded connection, threaded connection, flanged connection, quick connector, or tubing connector.

4. The wet abrasive system of claim 1, wherein the automatic vent valve is one of a float type vent valve, a diaphragm-type vent valve or an electronic vent valve.

5. A wet abrasive system, comprising a blast pot, wherein the blast pot comprises a cylindrical side wall, an outlet in the cylindrical side wall at an kipper most portion of an inner volume of the blast pot, an inwardly sloping top in the general shape of a basin, and a self-venting assembly, wherein the upper most portion of the inner volume of the blast pot is defined between an underside of the inwardly sloping top and an inside top of the cylindrical side wall of the blast pot and the self-venting assembly is connected to the outlet in the cylindrical side wall at the upper most portion of an inner volume of the blast pot;

a mixer;

a blast hose in fluid communication with the mixer;

a slurry piping system connecting the bottom outlet of the blast pot to the mixer;

a pressurized air piping system capable of connecting a source of pressurized air to the mixer;

the self-venting assembly, comprises:

an automatic vent valve, wherein the automatic vent valve opens to release air from the blast pot that may become trapped in the space between the underside of the inwardly sloping top and an inside top of the cylindrical body of the blast pot, without releasing a significant amount of fluid, through the automatic vent valve until the fluid level fills the tank and the automatic vent valve is automatically sealed to prevent escape of liquid; and a separator between the blast pot and the automatic vent valve capable of separating at least a portion of any solids from liquid.

6. The wet abrasive system of claim 5, wherein the separator is at least one of a gravity separator, a filter or screen.

7. A wet abrasive system, comprising:

a blast pot, wherein the blast pot comprises a cylindrical side wall, an outlet in the cylindrical side will at an upper most portion of an inner volume of the blast pot, an inwardly sloping top in the general shape of a basin, and a self-venting assembly, wherein the self-venting assembly is connected to the outlet in the cylindrical side wall, wherein the upper most portion of the inner volume of the blast pot is defined between an underside of the inwardly sloping top and an inside top of the cylindrical side wall of the blast pot and;

a mixer;

a blast hose in fluid communication with the mixer;

a slurry piping system connecting the bottom outlet of the blast pot to the mixer;

a pressurized air piping system capable of connecting a source of pressurized air to the mixer; and the self-venting assembly, comprises:

an automatic vent valve that operates based upon a sensor measuring air within the blast pot, wherein the automatic vent valve opens to release air from the blast pot that may become trapped in the upper most portion of the inner volume, without releasing a significant amount of fluid, through the automatic vent valve until the fluid level fills the tank and the automatic vent valve is automatically sealed to prevent escape of liquid, wherein the automatic vent valve is a float type vent valve comprising a chamber, a vent seal, a float and a seat, wherein if air enters the automatic vent valve, the float moves to a lower position to allow the air or other gases to escape the chamber.

* * * * *